US008331578B2

(12) United States Patent
Raussi et al.

(10) Patent No.: US 8,331,578 B2
(45) Date of Patent: Dec. 11, 2012

(54) APPARATUS, METHOD AND COMPUTER PROGRAM FOR PROVIDING AN ACOUSTIC OUTPUT SIGNAL USING AN EARPIECE

(75) Inventors: Tommi Antero Raussi, Halikko (FI); Jari Toropainen, Espoo (FI); Antti Pekka Kelloniemi, Helsinki (FI)

(73) Assignee: Nokia Corporation, Espoo (FI)

( * ) Notice: Subject to any disclaimer, the term of this patent is extended or adjusted under 35 U.S.C. 154(b) by 571 days.

(21) Appl. No.: 12/456,566

(22) Filed: Jun. 17, 2009

(65) Prior Publication Data

US 2010/0322434 A1 Dec. 23, 2010

(51) Int. Cl.
*H04R 1/10* (2006.01)

(52) U.S. Cl. ..... 381/74; 381/71.1; 381/71.14; 381/69; 381/68; 381/380

(58) Field of Classification Search ..... 381/71.1–71, 381/14, 69, 68, 380, 374, 72
See application file for complete search history.

(56) References Cited

U.S. PATENT DOCUMENTS

| | | | | |
|---|---|---|---|---|
| 4,375,016 | A * | 2/1983 | Harada | 181/135 |
| 5,341,433 | A * | 8/1994 | Meyer et al. | 381/324 |
| 7,349,550 | B2 * | 3/2008 | Oliveira et al. | 381/380 |
| 2005/0250559 | A1 | 11/2005 | Nassimi | |
| 2006/0042867 | A1 * | 3/2006 | Haussmann et al. | 181/135 |
| 2006/0093159 | A1 * | 5/2006 | Koh et al. | 381/98 |
| 2006/0233413 | A1 * | 10/2006 | Nam | 381/380 |
| 2007/0041605 | A1 * | 2/2007 | Yang | 381/370 |
| 2007/0237349 | A1 * | 10/2007 | Donaldson et al. | 381/380 |
| 2007/0297634 | A1 * | 12/2007 | Hansson | 381/384 |
| 2008/0044003 | A1 * | 2/2008 | Yang | 379/430 |
| 2008/0130906 | A1 * | 6/2008 | Goldstein et al. | 381/58 |
| 2008/0152163 | A1 | 6/2008 | Mulvey | 381/74 |
| 2008/0152187 | A1 | 6/2008 | Kawazu | |
| 2009/0103764 | A1 * | 4/2009 | Stiehl et al. | 381/380 |

FOREIGN PATENT DOCUMENTS

| | | | |
|---|---|---|---|
| GB | 2 362 535 | A | 11/2001 |
| GB | 2 376 831 | A | 12/2002 |
| WO | WO 2007/028659 | A1 * | 3/2007 |

* cited by examiner

*Primary Examiner* — Davetta W Goins
*Assistant Examiner* — Kuassi Ganmavo
(74) *Attorney, Agent, or Firm* — Harrington & Smith

(57) ABSTRACT

An apparatus, method and computer program, the apparatus including a loudspeaker configured to convert an electrical input signal into an acoustic output signal; a connecting portion configured to interchangeably connect to either a first adapter or a second adapter where the first adapter is configured to fit in a user's ear canal and the second adapter is configured to fit to a user's concha; and a regulator for regulating sound pressure level created by the acoustic output signal at an ear drum of the user in dependence on whether the first adapter or the second adapter is connected to the connecting portion.

15 Claims, 7 Drawing Sheets

APPARATUS, METHOD AND COMPUTER PROGRAM FOR PROVIDING AN ACOUSTIC OUTPUT SIGNAL USING AN EARPIECE

FIELD OF THE INVENTION

Embodiments of the present invention relate to an apparatus, method and computer program. In particular, they relate to an apparatus, method and computer program for providing an acoustic output signal.

BACKGROUND TO THE INVENTION

Earpieces which enable a user to position a small loudspeaker close to or in their ear are well known. There are different types of ear pieces available. For example some earpieces are configured to fit inside the ear canal of a user while others are configured to fit adjacent to the ear canal.

A user may wish to use the same audio apparatus with different types of earpieces.

BRIEF DESCRIPTION OF VARIOUS EMBODIMENTS OF THE INVENTION

According to various, but not necessarily all, embodiments of the invention there is provided an apparatus comprising: a loudspeaker configured to convert an electrical input signal into an acoustic output signal; a connecting portion configured to interchangeably connect to either a first adapter or a second adapter where the first adapter is configured to fit in a user's ear canal and the second adapter is configured to fit to a user's concha; and a regulator for regulating sound pressure level created by the acoustic output signal at an ear drum of the user in dependence on whether the first adapter or the second adapter is connected to the connecting portion.

In some embodiments of the invention the regulator may comprise a detector for detecting whether the first adapter or the second adapter is connected to the connecting portion. The regulator may also comprise a filter for filtering the electrical input signal provided to the loudspeaker to control the acoustic output signal provided by the loudspeaker. The filter may further reduce the amplitude of low frequency components of the acoustic output signal. The filtered acoustic output signal may prevent injury to a user, from excessive sound pressure level caused by the acoustic output signal, when the first adapter is connected to the connecting portion.

In some embodiments of the invention the regulator may comprise an aperture which is not sealed when the first adapter is connected to the connecting portion. The aperture may be sealed when the second adapter is connected to the connecting portion.

In some embodiments of the invention the connecting portion may be configured to enable a user to interchange between the first and second adapters.

In some embodiments of the invention the connecting portion may be configured to connect to one of a plurality of different adapters including at least the first adapter, the second adapter and a third adapter.

According to various, but not necessarily all, embodiments of the invention there is provided a method comprising: converting an electrical input signal into an acoustic output signal; connecting, either a first adapter or a second adapter where the first adapter is configured to fit in a user's ear canal and the second adapter is configured to fit to a user's concha; and regulating sound pressure level created by the acoustic output signal at an ear drum of the user in dependence on whether the first adapter or the second adapter is connected to the connecting portion.

In some embodiments of the invention the method may also comprise detecting whether the first adapter or the second adapter is connected to the connecting portion. In response to detecting that the first adapter is connected, the electrical input signal provided to the loudspeaker may be filtered to control the acoustic output signal provided by the loudspeaker. The filtering may reduce the amplitude of low frequency components of the acoustic output signal. The filtered signal may prevent injury to a user, from excessive sound pressure level caused by the acoustic output signal, when the first adapter is connected to the connecting portion.

In some embodiments of the invention the method may comprise regulating the sound pressure level created by the acoustic output signal at an ear drum of the user by opening an aperture when the first adapter is connected.

According to various, but not necessarily all, embodiments of the invention there is provided a computer program comprising computer program instructions configured to control an apparatus, the program instructions providing, when loaded into a processor; means for determining whether a first adapter or a second adapter is connected to the apparatus where the first adapter is configured to fit in a user's ear canal and the second adapter is configured to fit to a user's concha: and means for regulating sound pressure level created by an acoustic output signal at an ear drum of the user in dependence on whether the first adapter or the second adapter is connected to the apparatus.

In some embodiments of the invention there may be provided a computer program comprising program instructions for causing a computer to perform the method described above.

In some embodiments of the invention there may be provided an electromagnetic carrier signal carrying the computer program as described above.

In some embodiments of the invention there may be provided a computer-readable storage medium encoded with instructions that, when executed by a processor, perform the method as described above.

According to various, but not necessarily all, embodiments of the invention there is provided an apparatus comprising: a loudspeaker configured to convert an electrical input signal into an acoustic output signal; a connecting portion configured to interchangeably connect to either a first adapter or a second adapter where the first adapter is configured to fit in a user's ear canal and the second adapter is configured to fit to a user's concha; and a regulator for regulating sound pressure level created by the acoustic output signal in the user's ear canal when the first adapter is connected to the connecting portion to prevent injuring the user.

The apparatus may be for providing an acoustic signal. For example, the apparatus may be an earphone.

According to various, but not necessarily all, embodiments of the invention there is provided an apparatus comprising: a first portion for fitting to a user's ear and providing an acoustic output signal to a user's ear; a connecting portion configured to enable the apparatus to be interchangeably connected to a further apparatus; and a regulator for regulating sound pressure level created by the audio output signal at an ear drum of the user's ear in dependence upon which part of the ear the apparatus is fitted to.

In some embodiments of the invention the apparatus may comprise a loudspeaker for providing the acoustic signal.

The apparatus may be for coupling an audio apparatus to a user's ear. For example the apparatus may be an adapter.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
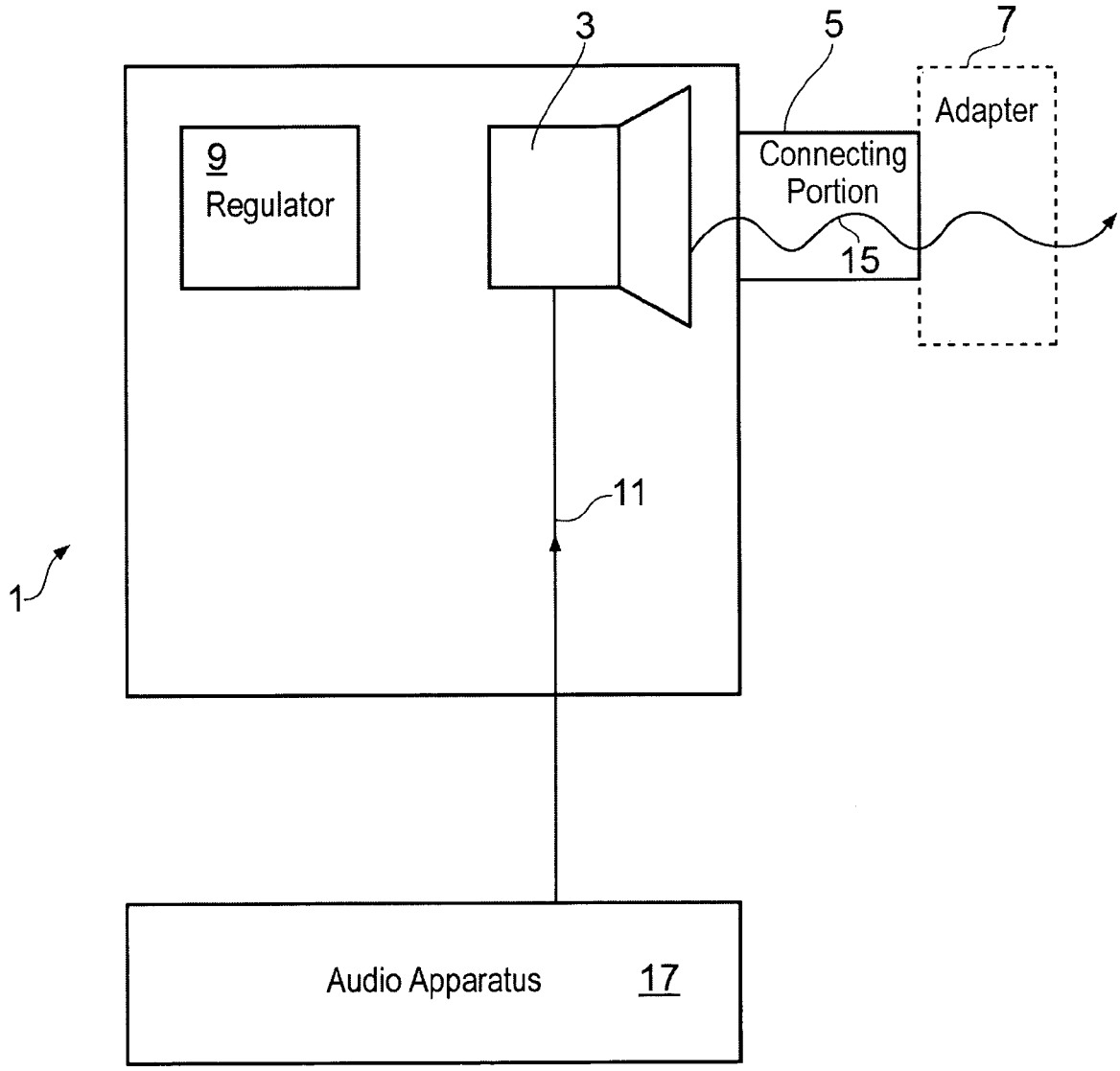
FIG. 1 illustrates an apparatus according to embodiments of the invention.

The Figures illustrate an apparatus 1 comprising: a loudspeaker 3 configured to convert an electrical input signal 11 into an acoustic output signal 15; a connecting portion 5 configured to interchangeably connect to either a first adapter 7A or a second adapter 7B where the first adapter 7A is configured to fit in a user's ear canal 33 and the second adapter 7B is configured to fit to a user's concha 31; and a regulator 9 for regulating sound pressure level created by the acoustic output signal 15 at an ear drum of the user in dependence on whether the first adapter 7A or the second adapter 7B is connected to the connecting portion 5.

In the following description, unless expressly stated otherwise, the words "connect" and "couple" and their derivatives mean operationally connected or operationally coupled. It is to be appreciated that any number or combination of intervening components can exist including no intervening components.

FIG. 1 schematically illustrates an apparatus 1 according to a first embodiment of the invention. The apparatus 1 comprises a loudspeaker 3, a connecting portion 5, and a regulator 9.

The apparatus 1 may be an earpiece or any apparatus which is designed to fit in or adjacent to a user's ear and provide an acoustic output signal 15. In the illustrated embodiments the apparatus 1 comprises a single earpiece. It is to be appreciated that, in some embodiments of the invention, the apparatus 1 may comprise two earpieces—one for each ear.

The apparatus 1 is configured to receive an input signal 11 from an audio apparatus 17. The audio apparatus 17 may be any means which produces an audio output. For example, it may be a cellular mobile telephone and the input signal 11 received by the apparatus 1 may correspond to speech which is part of a telephone conversation. In other embodiments the audio apparatus 17 may be an apparatus configured to play stored audio files. The stored audio files may be pure audio files, for example, music files or video files which comprise both audio information and image information.

The input signal 11 may arrive at the apparatus 1 via any suitable communication link. For example the input signal 11 may be received as an electrical signal over a wired connection or as a radio signal over a wireless connection such as a Bluetooth or Wireless local area network (WLAN) link.

The input signal 11 which is received by the apparatus 1 is provided as an electrical input signal 11 to the loudspeaker 3.

The loudspeaker 3 may be any means which is configured to receive an electrical input signal 11 and convert the electrical input signal 11 to an acoustic output signal 15. The loudspeaker 3 may comprise a transducer.

The apparatus 1 comprises a connecting portion 5. The connecting portion 5 is configured to enable different types of adapters 7 to be removeably connected to the apparatus 1. An adapter 7 is indicated in dashed lines in FIG. 1.

The connecting portion may comprise any means which enables a user to interchangeably connect different types of adapter to the apparatus 1. In some embodiments of the invention the connecting portion 5 may connect directly to the adapter 7. For example the connecting portion 5 may comprise a projection which is configured to fit tightly into a corresponding opening of an adapter 7. A user may be able to remove the adapter 7 by pulling the adapter 7 from the connecting portion 5. The user may then able to replace the adapter 7 with a different adapter 7.

In other embodiments of the invention there may be intervening components between the connecting portion 5 and the adapter 7. For example the connecting portion 5 of the apparatus 1 may comprise means for receiving an elongate member. The elongate member may be connected to an adapter 7. The user may be able to remove the adapter 7 by removing the elongate member from the apparatus 1.

The adapter 7 is configured to fit to a user's outer ear. Different types of adapter may be fitted to different portions of a user's outer ear. Different types of adapters are illustrated in FIGS. 2 to 5.

The acoustic output signal 15 provided by the loudspeaker 3 is provided through the connecting portion 5 and the adapter 7 to a user's ear.

In embodiments of the invention the apparatus 1 comprises a regulator 9. The regulator 9 may be any means which enables a sound pressure level generated by the acoustic output signal 15 at the user's ear drum to be adjusted to within a predetermined level. The regulator may be implemented using mechanical means or electrical means. Different types of regulator according to various embodiments of the invention are described in more detail below.

Figure 2:
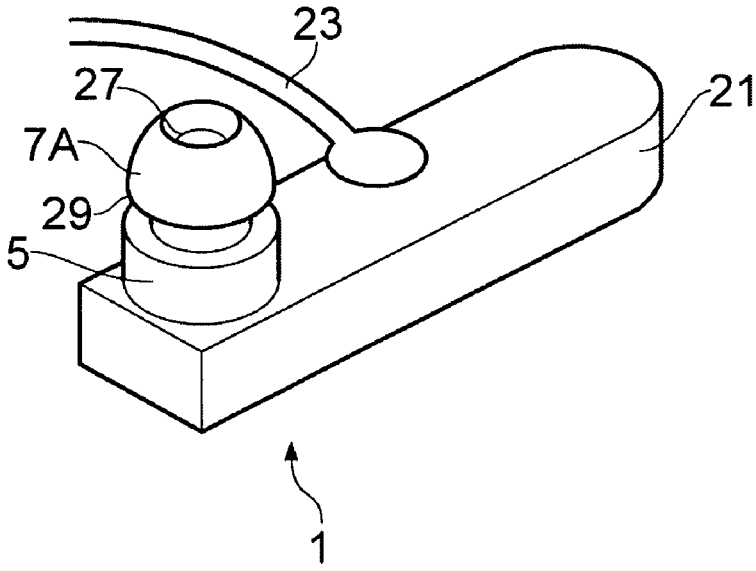
FIG. 2 illustrates an apparatus according to an embodiment of the invention with a first adapter connected.

FIG. 2 illustrates an apparatus 1 according to embodiments of the invention with a first adapter 7A connected to the connecting portion 5. In FIG. 2 the loudspeaker 3 is contained within the housing 21 and so is not visible in FIG. 2.

In the illustrated embodiment the connecting portion 5 comprises a projection out of the surface of the housing 21. The first adapter 7A comprises an opening which fits tightly around the projection so that the first adapter 7A is secured to the connecting portion 5.

The first adapter 7A comprises a bud shaped portion 29 which is configured to fit snugly within a users' ear canal 33. The bud shaped portion 29 is substantially cylindrical but tapers at the end which is not connected to the housing 21. The bud shaped portion 29 also comprises a hole 27 through which the audio signal 15 is provided to the user's ear.

Figure 3:
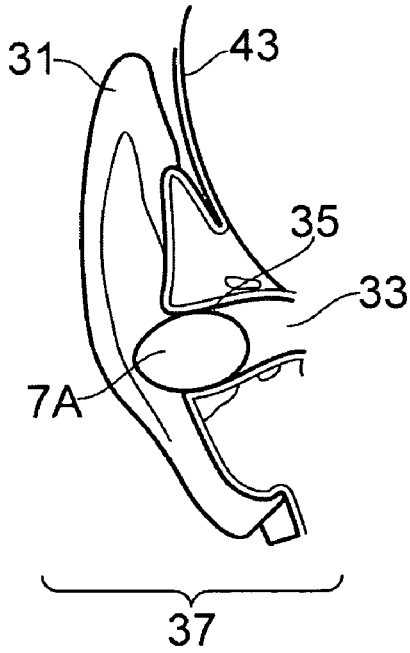
FIG. 3 illustrates a first adapter, according to embodiments of the invention, in position in a user's ear.

FIG. 3 illustrates the first adapter 7A in position a user's ear canal 33. For clarity only the adapter 7A is illustrated.

The respective portions of an external ear 37 are illustrated in FIG. 3. The external ear 37 comprises the concha 31 and the ear canal 33. The ear canal 33 leads to the ear drum which is not illustrated in FIG. 3. Acoustic signals incident on the ear drum are transmitted to the inner ear. The line 43 indicates the side of the users head.

The first adapter 7A fits inside the ear canal 33. In the illustrated embodiment the first adapter 7A fits tightly in the entrance 35 to the ear canal 33 so that the adapter 7A blocks the entrance 35 to the ear canal 33. As the adapter 7A fits tightly to the ear canal 33 there is no gap between the first adapter 7A and the user's ear.

As there is no gap between the first adapter 7A and the user's ear the first adapter 7A provides sound insulation. This attenuates noise being transmitted into the ear canal 33 and reduces the ambient noise which the user hears. It also prevents the acoustic signal 15 from leaking so that people around the user do not hear the acoustic signal 15.

Figure 4:
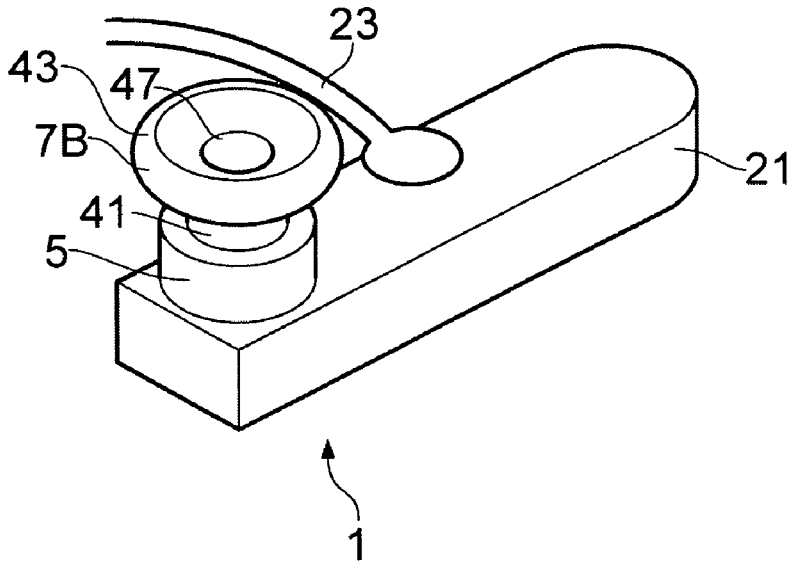
FIG. 4 illustrates an apparatus according to an embodiment of the invention with a second adapter connected.
Figure 5:
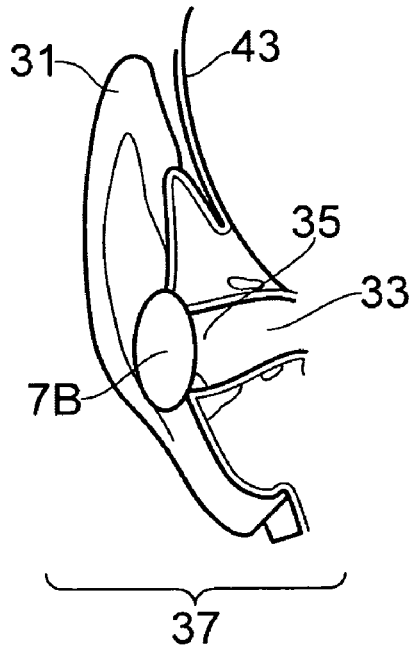
FIG. 5 illustrates a second adapter, according to embodiments of the invention, in position in a user's ear.

As the entrance 35 to the ear canal 33 is blocked by the adapter 7A this increases the sound pressure level created within the ear canal 33 when an audio signal 15 is provided, compared to the sound pressure level created when a different type of adapter 7 is used, such as the second adapter 7B illustrated in FIGS. 4 and 5. This may mean that a user hears the signal as being louder, however, if the sound pressure level exceeds a particular level it may cause injury to the user.

FIG. 4 illustrates the apparatus 1 illustrated in FIG. 2 with a second adapter 7B connected to the connecting portion 5 instead of the first adapter 7A. The second adapter 7B also comprises an opening which fits tightly around the projection of the connecting portion 5 so that the second adapter 7B is connected to the connecting portion 5 in a similar manner to the first adapter 7A.

The second adapter 7B has a different shape to the first adapter 7A. The second adapter 7B has a cylindrical body portion 41 which is removeably connected to the connecting portion 5. A top portion 43 is connected to the body portion 41. The top portion 43 is also substantially cylindrical but has a larger diameter than the body portion so that the second adapter 7B is mushroom shaped. The top portion 43 has a substantially flat upper surface 45 which may be positioned in the concha 31 of a user's ear so that the upper surface 45 is adjacent to the ear canal 33. The upper surface 45 comprises a hole 47 through which the audio signal 15 is provided to a user's ear.

FIG. 5 illustrates the second adapter 7B in position a user's ear. For clarity only the adapter 7B is illustrated.

The second adapter 7B fits to the concha 31 of the user's ear. The diameter of the top portion 45 of the second adapter 7B may be such that the second adapter 7B fits tightly within the concha 31 adjacent to the entrance 35 of the ear canal 33. There may some gaps between the entrance to the ear canal 35 and the second adapter 7B.

As there are gaps between the second adapter 7B and the user's ear the second adapter 7B does not provide as good sound insulation as the first adapter 7A. When using the second adapter 7A the user may still hear ambient noise from the surrounding environment which reduces the quality of the sound which is heard by the user. The gaps may also result in a reduction of the sound quality of the acoustic signal 15 perceived by the user.

The sound pressure level created within the ear canal for a given audio signal will not be as large when the second adapter 7B is used instead of the first adapter 7A. This means that the amplitude of the acoustic output signal 15 may be larger than that used with a first adapter 7A, without damaging the user's ear.

The adapters 7A and 7B may be made of any suitable material such as a foam or elastomer. It is to be appreciated that the shapes of the adapters 7A, 7B described above are examples and that other shapes of adapters may be used in other embodiments of the invention.

Figure 6:
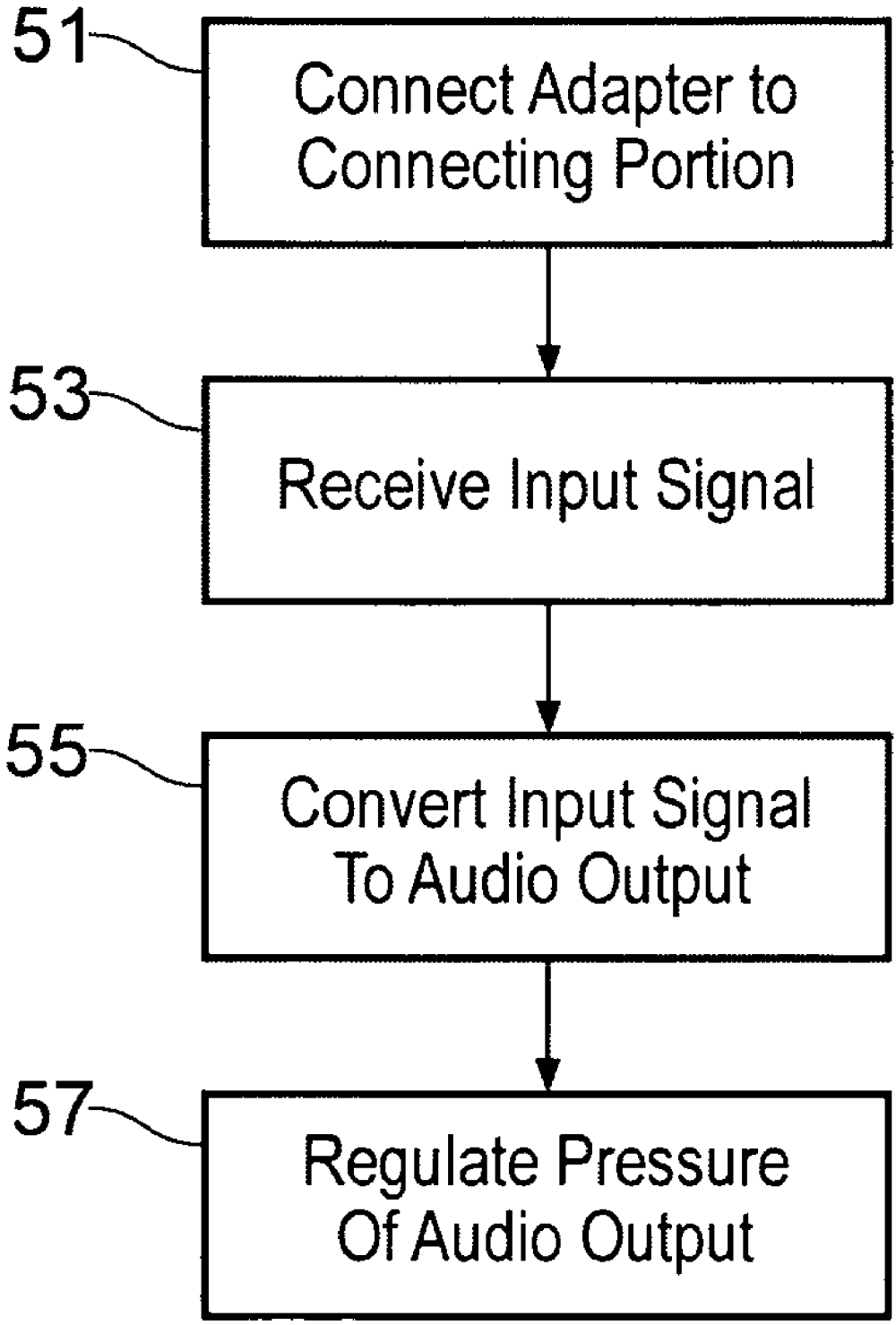
FIG. 6 illustrates a flow chart showing method blocks of embodiments of the invention.

A method of using the apparatus 1 according to embodiments of the invention is illustrated in FIG. 6.

At block 51 a user connects an adapter 7 to the connecting portion 5 of the apparatus 1. The adapter may be either a first adapter 7A which is configured to fit inside a user's ear canal 33 or a second adapter 7B which is configured to fit to a concha 31 and may be positioned adjacent to an ear canal 33.

The user may select whichever type of adapter 7 they prefer, for example they may find one type of adapter 7 more comfortable than another. The user may be able to use different types of adapter 7 at different times or for different uses. For example they might use the first adapter 7A when using the apparatus 1 in a noisy environment as this provides better sound insulation but they may prefer to use the second type of adapter 7B at other times because this may be more comfortable for them.

At block 53 the apparatus 1 receives an input signal from the audio apparatus 17. As mentioned above the input signal may be received as an electrical signal via a wired connection or a radio signal via a wireless connection. The input signal 11 is provided to the loudspeaker 3 as an electrical input signal 11.

At block 55 the loudspeaker 3 converts the electrical input signal 11 into an acoustic output signal 15 which is provided to a user's ear via an adapter 7.

At block 59 the regulator 9 regulates the pressure created by the acoustic output signal 15 at a user's ear drum in dependence upon whether the first adapter 7A or the second adapter 7B is connected to the connecting portion 5. The regulator 9 may modify the acoustic output signal 15 which is provided to the user's ear canal 33 so that the sound pressure level does not reach a level which may injure a user. The way in which the regulator 9 modifies the acoustic output signal 15 may depend upon which adapter 7A, 7B is connected to the connecting portion 5 because the amplitude of the acoustic output signal 15 which would cause damage to the user may depend on the type of adapter 7 connected to the apparatus 1.

For example, if the second adapter 7B is connected to the connecting portion 5 then the acoustic output signal 15 may be provided having a first amplitude which creates a first sound pressure level in the user's ear canal 33. If the same acoustic output signal 15, having the same amplitude, is not regulated and is used when a first type of adapter 7A is connected this may create a higher sound pressure level because the first adapter 7A seals the user's ear canal 33 and also is closer to the user's ear drum. Although the acoustic output signal 15 may be appropriate for use with the second adapter 7A it may be dangerous to use with the first adapter 7B. Therefore the regulator 9 prevents acoustic output signals which may damage a user's ear from being used with the first adapter 7A but may enable such acoustic output signals to be used with a second adapter 7B where they would not cause damage but may provide a better sound quality.

Figure 7A:
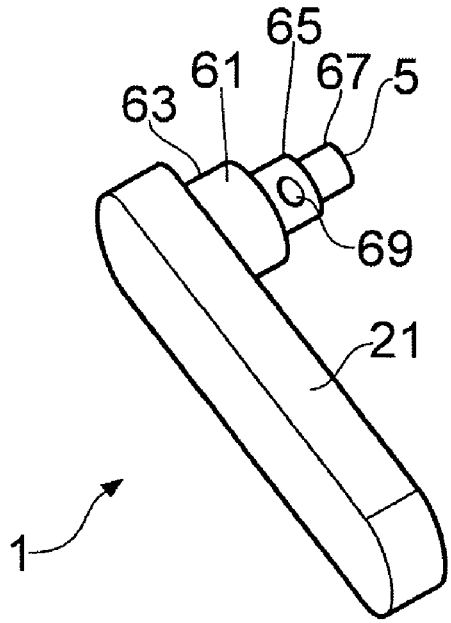
FIGS. 7A to 7C illustrate an apparatus according to first embodiment of the invention.
Figure 7B:
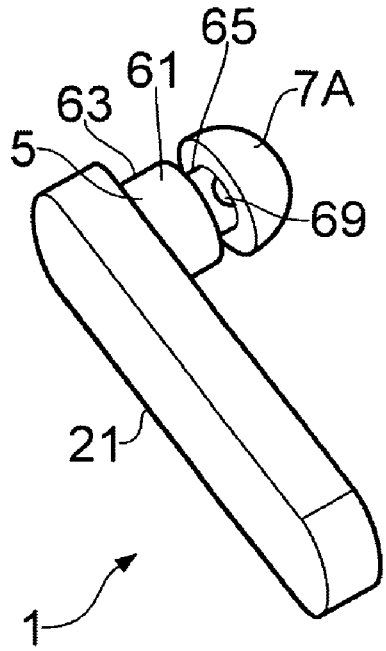
Figure 7C:
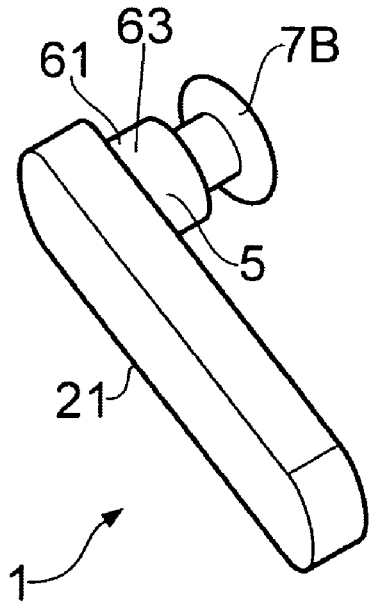

The regulator 9 may be mechanical or electrical or a combination of both. FIGS. 7A to 7C illustrate an embodiment of the invention with a mechanical regulator 9.

FIG. 7A illustrates an apparatus 1 without an adapter 7 connected. The apparatus comprises a housing 21. The loudspeaker 3 and other possible electronic components are located within the housing 21. The connecting portion 5 comprises a projection 61 which projects out of the housing 21. In the illustrated embodiment the projection 61 comprises three portions, a first portion 63, a second portion 65 and a third portion 67. The three portions 63, 65 and 67 are positioned on top of each other so that the first portion 63 abuts the housing 21 and the second portion 65 abuts the first portion 63 and the third portion 67. Each of the portions 63, 65, 67 are substantially cylindrical. The three portions 63, 65 and 67 are positioned so they are aligned axially with each other. The first portion 63 has the largest diameter and the third portion 67 has the smallest diameter.

An aperture 69 is provided within the projection 61. In the illustrated embodiment the aperture 69 is provided in the second portion 65 of the projection 61. The aperture 69 is configured so that when an acoustic output signal 15 is provided by the loudspeaker 3 some of the acoustic output signal 15 may be directed through the aperture 69.

FIG. 7B illustrates the apparatus 1 of FIG. 7A with a first adapter 7A attached. The first adapter 7A is configured to fit inside the ear canal 33 of a user, as described above in relation to FIGS. 2 and 3, so that there is no gap between the first adapter 7A and the ear canal 33.

The first adapter 7A is connected to the connecting portion 5. The first adapter 7A comprises an opening which fits tightly over the projection 61. The opening of the first adapter 7A is sized and shaped so that it only fits over the third portion 67 of the projection 61. The third portion 67 of the projection is not illustrated in FIG. 7B as it is covered by the first adapter 7A.

As the first adapter 7A does not fit over the second portion 65 of the projection 61 the aperture 69 is left uncovered. When the apparatus 1 is in use with the first adapter 7A the aperture 69 creates a gap and prevents the apparatus 1 and adapter 7A from sealing the entrance 35 to the ear canal 33. This reduces the sound pressure level generated when a given acoustic output signal 15 is provided by the loudspeaker 3. Therefore the aperture 69 acts as a regulator 9 to limit the sound pressure level created by the acoustic output signal 15 in the ear canal 33 and prevent injury to the user.

FIG. 7C illustrates the apparatus 1 of FIGS. 7A and 7B with a second adapter 7B attached. The second adapter 7B is configured to fit to the concha 31 of a user, as described above in relation to FIGS. 4 and 5, so that there is a gap between the first adapter 7A and the ear canal 33.

The second adapter 7B is also connected to the connecting portion 5. The second adapter 7B comprises an opening which fits snugly over the projection 61. The opening of the first adapter 7B is sized and shaped so that it fits over both the third portion 67 and the second portion 65 of the projection 61. The second portion 65 third portion 67 of the projection 61 are not illustrated in FIG. 7C as they are covered by the second adapter 7B.

When the second adapter 7B is connected to the connecting portion 5 the aperture 69 is covered by the second adapter 7B. This seals the aperture 69 and prevents the acoustic output signal 15 provided by the loudspeaker 3 from leaking through the aperture 69 and also prevents ambient noise from the external environment from entering through the aperture 69. This provides an improved signal quality for the user as it reduces the amount of ambient noise they can hear and also reduces the attenuation of the acoustic output signal 15.

The embodiments of the invention illustrated in FIGS. 7A to 7C provide the advantage that they enable the same apparatus 1 to be used with different types of adapters 7. This gives the user the freedom to choose which type of adapters 7 they prefer and change the type of adapter 7 used whenever they want to. The use of the aperture 69 as a regulator 9 prevents a user from damaging their ear when using the first adapter 7A. Sealing the aperture 69 when the second adapter 7B is being connected enables a similar level of sound quality to be provided with both the first adapter 7A and the second adapter 7B because when the second adapter 7B is used there is a gap between the adapter 7B and the user's ear which causes leakage whereas the first adapter 7A fits snugly in the ear canal 33.

It is to be appreciated that in other embodiments of the invention other mechanical structures may be implemented to regulate the sound pressure level created by the audio output signal 15 in the ear canal 33. For example the size of the aperture in the adapter 7 may be varied.

Figure 8:
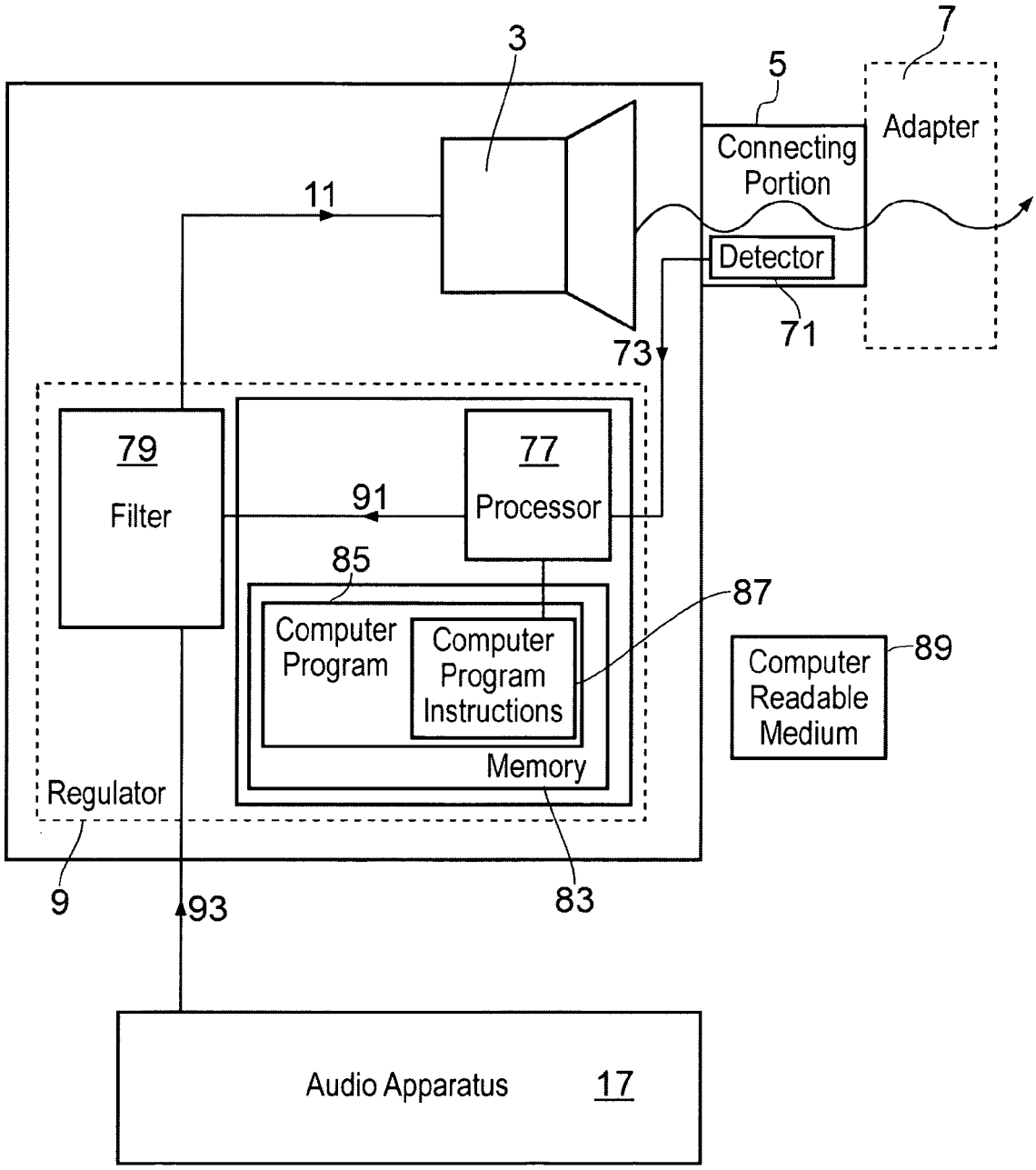
FIG. 8 illustrates an apparatus according to a second embodiment of the invention.

FIG. 8 schematically illustrates an apparatus 1 according to an embodiment of the invention in which an electrical regulator 9 is used. The apparatus 1 comprises a loudspeaker 3 and a connector 5 as described above.

The apparatus 1 also comprises a regulator 9 and a detector 71. The regulator 9 comprises a controller 75 and a filter 79.

The detector 71 is configured to detect whether a first adapter 7A or a second adapter 7B is connected to the connecting portion 5. The detector 71 may comprise any means which are configured to detect that an adapter 7 has been connected and provide an electrical signal 73 in response to the detection. The electrical signal 73 provided by the detector 71 is dependent upon the type of adapter 7 that has been connected. A first signal 73 is provided when a first adapter 7A is connected and a second, different signal 73 is provided when a second adapter 7B is connected. In some embodiments of the invention the detector 71 may also be able to detect other types of adapters.

The output signal 73 of the detector 71 is provided to the controller 75 of the regulator 9.

The controller 75 provides means for controlling the filter 79. In some embodiments of the invention the controller 75 may also control other functions of the apparatus 1. In the illustrated embodiment the controller 19 comprises a processor 77 and a memory 83.

The controller 75 may be implemented using instructions that enable hardware functionality, for example, by using executable computer program instructions 87 in a general-purpose or special-purpose processor 77 that may be stored on a computer readable storage medium 89 (e.g. disk, memory etc) to be executed by such a processor 77.

The memory 83 stores a computer program 85 comprising computer program instructions 87 that control the operation of the filter 79 when loaded into the processor 77. The computer program instructions 87 provide the logic and routines that enables the apparatus 1 to perform the methods illustrated in FIG. 9. The processor 77 by reading the memory 83 is able to load and execute the computer program 85.

The computer program instructions 87 may provide computer readable program means for determining whether a first adapter 7A or a second adapter 7B is connected to the apparatus 1 where the first adapter 7A is configured to fit in a user's ear canal 33 and the second adapter 7B is configured to fit to a user's concha 31: and means for regulating sound pressure level created by an acoustic output signal 15 at an ear drum of the user in dependence on whether the first adapter 7A or the second adapter 7B is connected to the apparatus 1.

The computer program 85 may arrive at the apparatus 1 via any suitable delivery mechanism 89. The delivery mechanism 89 may be, for example, a computer-readable storage medium, a computer program product, a memory device such as a flash memory, a record medium such as a CD-ROM or DVD, an article of manufacture that tangibly embodies the computer program 85.

The delivery mechanism 89 may be a signal configured to reliably transfer the computer program 85. The apparatus 1 may propagate or transmit the computer program 85 as a computer data signal.

Although the memory 83 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific integration circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device.

The controller 75 is configured to receive the output signal 73 from the detector 73 as an input. The controller 75 is also configured to provide a control signal 91 to the filter which controls the filter 79.

The filter 79 is configured to receive an input signal 93 from an audio apparatus 17. As described above the input signal 75 may arrive at the apparatus 1 via any suitable communication link such as a wired or wireless communication link. The filter 79 is configured to filter the signal 93 received from the audio apparatus in dependence upon the control signal 91 received from the controller.

The filter is also configured to provide a filtered signal 11 to the loudspeaker 3. The loudspeaker 3 is configured to convert the filtered signal 11 into an acoustic output signal 15. The sound pressure level of the acoustic signal 15 in the ear canal 33 is controlled by the way in which the filter 79 filters the signal 93.

Figure 9:
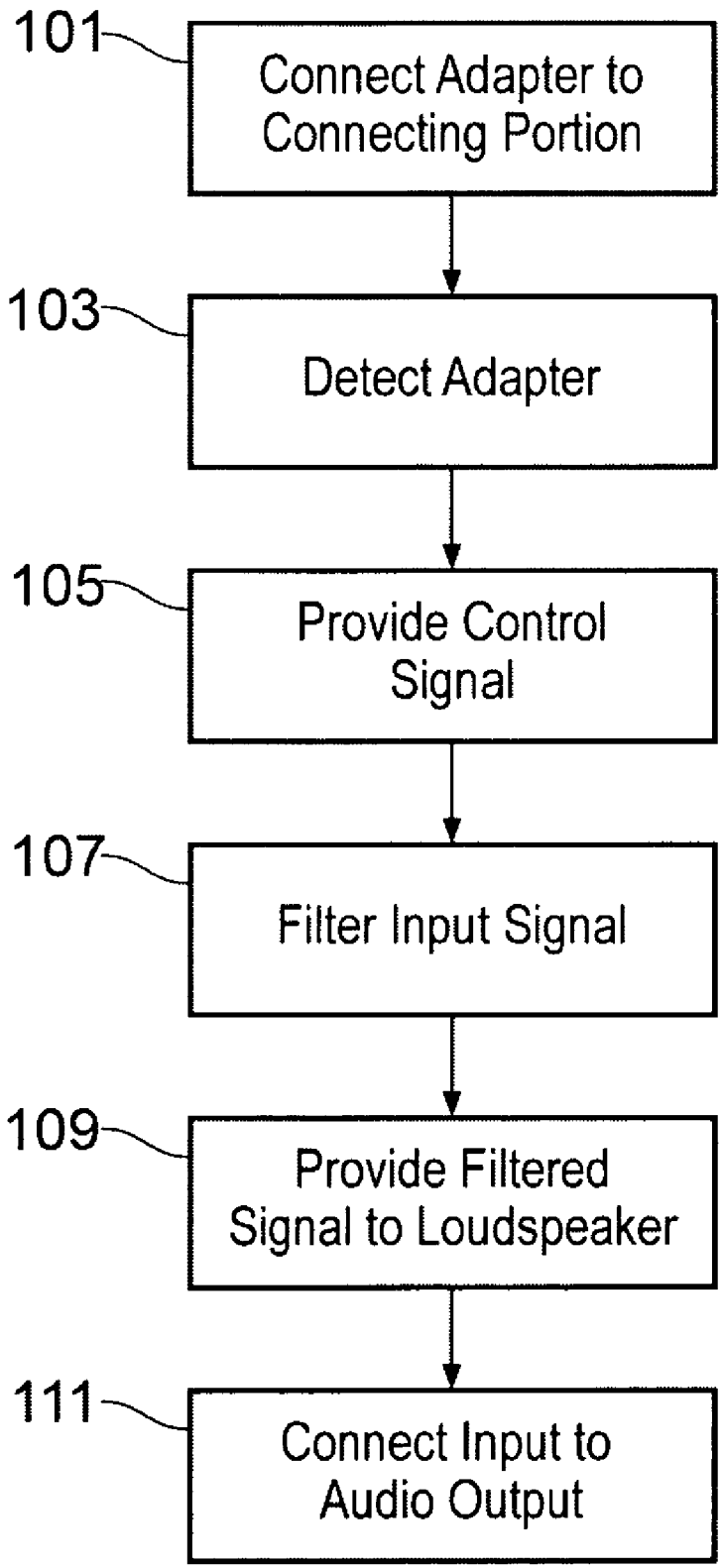
FIG. 9 illustrates a flow chart showing method blocks of the second embodiment of the invention

A method of using the apparatus 1 according to embodiments of the invention which use an electronic regulator 9 is illustrated in FIG. 9.

At block 101 a user connects an adapter 7 to the connecting portion 5 of the apparatus 1. The adapter may be either a first adapter 7A which is configured to fit inside a user's ear canal 33 or a second adapter 7B which is configured to fit to a concha 31 and may be positioned adjacent to an ear canal 33. In other embodiments of the invention there may be more than two different types of adapter 7.

At block 103 the detector 71 detects that an adapter has been connected to the connecting portion and provides an output signal 73 which is dependent upon the type of adapter 7 connected. As mentioned above a first signal 73 is provided when a first adapter 7A is connected and a second, different signal 73 is provided when a second adapter 7B is connected.

At bock 105 the controller 75 receives the signal 73 from the detector and, in response to the receipt of the signal 73, provides a control signal 91 to the filter 79. The control signal 91 controls the filter 79 and is dependent upon the type of adapter 7 which has been connected. That is, a first control signal 91 is provided if a first adapter 7A is connected and a second, different, control signal 91 is provided if a second adapter 7B is connected.

At block 107 the apparatus 1 receives an input signal 93 from the audio apparatus 17 and filters the signal. The signal 93 may be filtered to further attenuate the acoustic output signal 15 to reduce the sound pressure level at the user's ear drum. The way in which the signal is filtered is dependent upon the control signal 91 which is provided to the filter 79 so that the input signal 93 is filtered differently depending on whether a first adapter 7A or a second adapter 7B is connected.

For example, if a first adapter 7A is connected the filter 79 may filter the signal to reduce the low frequency components of the acoustic output signal 15 as these components create the greatest sound pressure level and may be most damaging to a user. The low frequency components may be those under 1000 Hz. The filter 79 may filter the input signal 93 so that the resultant audio output signal 15 never exceeds a certain sound pressure level. The sound pressure level may be 120 dB or a level defined in a standard such as the EN 50332-1:2000 standard.

If a second adapter 7B is connected it might not be necessary to filter the signal 93 to prevent damage to a user as the sound pressure level in the ear canal 33 is not as high when the second adapter 7B is used because there is a gap between the adapter 7B and the entrance to the ear canal 35. Although this gap may prevent damage to the user's ear it may degrade the perceived sound quality of the acoustic output signal 15. In some embodiments of the invention the filter 79 may be controlled to filter the input signal 93 to compensate for the perceived lack of sound quality.

At block 109 the loudspeaker 3 receives the filtered electrical input signal 11 and at block 111 the loudspeaker 3 converts the filtered electrical input signal 11 into an audio output signal which is provided to a user's ear via the adapter 7.

Therefore embodiments of the invention as illustrated in FIGS. 8 and 9 also provide the advantage that they enable the same apparatus 1 to be used with different types of adapters 7. However as there is no aperture introduced when using the first adapter 7A this may enable the sound quality provided to the user to be consistent when different types of adapters are used.

It is to be appreciated that other electronic structures may be used in order to filter and attenuate the acoustic output signal 15. For example the detector 71 may be connected to a passive electrical filter such as an LCR circuit which may be used to filter the input signal 15 provided to the loudspeaker.

The blocks illustrated in the FIGS. 6 and 9 may represent steps in a method and/or sections of code in the computer program 85. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example in the illustrated embodiment the electronic regulator 9 is located within the apparatus 1. In some embodiments of the invention the detector 71 may be located within the apparatus 1 but other components of the regulator 9 may be located within the audio apparatus 17 so that the input signal 11 is filtered before it is provided to the apparatus 1.

In some embodiments of the invention the regulator 9, or part of the regulator 9, may be provided on the adapter 7. For example the adapter 7 may comprise an aperture and the size of the aperture may be used to regulate the sound pressure level in the ear canal 33.

Also in the above described embodiments the loudspeaker 5 is located within the apparatus. In some embodiments the loudspeaker 5 may be connected to the adapter 7 so that a different loudspeaker is provided with each adapter.

Only two types of adapter are described above, however, it is to be appreciated that the apparatus 1 may be used with any number of different types of adapters.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising: a loudspeaker configured to convert an electrical input signal into an acoustic output signal; a connecting portion configured to interchangeably connect to either a first adapter or a second adapter where the first adapter is configured to fit in a user's ear canal and the second adapter is configured to fit to a user's concha; and a regulator for regulating sound pressure level created by the acoustic output signal at an ear drum of the user in dependence on whether the first adapter or the second adapter is connected to the connecting portion; wherein the regulator includes or is coupled to a detector for automatically detecting whether the first adapter or the second adapter is connected to the connecting portion; and in response to the detection the regulator is configured to filter the electrical input signal provided to the loudspeaker to control the acoustic output signal provided by the loudspeaker in dependence on whether the first adapter or the second adapter is connected to the connecting portion.

2. An apparatus as claimed in claim 1 wherein the filter reduces the amplitude of low frequency components of the acoustic output signal.

3. An apparatus as claimed in claim 1 wherein the filtered acoustic output signal prevents injury to a user, from excessive sound pressure level caused by the acoustic output signal, when the first adapter is connected to the connecting portion.

4. An apparatus as claimed in claim 1 wherein the regulator comprises an aperture which is not sealed when the first adapter is connected to the connecting portion.

5. An apparatus as claimed in claim 1 where the connecting portion is configured to enable a user to interchange between the first and second adapters.

6. An apparatus as claimed in claim 1 wherein the connecting portion is configured to connect to one of a plurality of different adapters including at least the first adapter, the second adapter and a third adapter.

7. A method comprising: converting an electrical input signal into an acoustic output signal; connecting, either a first adapter or a second adapter where the first adapter is configured to fit in a user's ear canal and the second adapter is configured to fit to a user's concha; regulating sound pressure level created by the acoustic output signal at an ear drum of the user in dependence on whether the first adapter or the second adapter is connected to the connecting portion; automatically detecting whether the first adapter or the second adapter is connected to the connecting portion; and filtering, in response to detecting that the first adapter is connected, the electrical input signal provided to the loudspeaker to control the acoustic output signal provided by the loudspeaker.

8. A method as claimed in claim 7 wherein the filtering reduces the amplitude of low frequency components of the acoustic output signal.

9. A method as claimed in claim 7 wherein the filtered acoustic output signal prevents injury to a user, from excessive sound pressure level caused by the acoustic output signal, when the first adapter is connected to the connecting portion.

10. A method as claimed in claim 7 comprising regulating the sound pressure level created by the acoustic output signal at an ear drum of the user by opening an aperture when the first adapter is connected.

11. A computer program comprising computer program instructions stored on a non-transitory computer-readable storage medium and configured to control an apparatus, the program instructions providing, when loaded into a processor;

means for automatically determining whether a first adapter or a second adapter is connected to the apparatus where the first adapter is configured to fit in a user's ear canal and the second adapter is configured to fit to a user's concha;

means for regulating sound pressure level created by an acoustic output signal at an ear drum of the user in dependence on whether the first adapter or the second adapter is connected to the apparatus; and means for filtering, in response to determining that the first adapter is connected, an electrical input signal provided to a loudspeaker to control the acoustic output signal as generated by the loudspeaker.

12. A computer program comprising program instructions stored on a non-transitory computer-readable storage medium for causing a computer to perform the method of claim 7.

13. A non-transitory computer-readable storage medium for storing program instructions from which an electromagnetic carrier signal is generated for carrying and executing the computer program as claimed in claim 11.

14. A non-transitory computer-readable storage medium encoded with instructions that, when executed by a processor, perform the method as claimed in claim 7.

15. An apparatus as claimed in claim 4 wherein the aperture is sealed when the second adapter is connected to the connecting portion.

* * * * *